United States Patent [19]

Duret et al.

[11] Patent Number: 4,757,323

[45] Date of Patent: Jul. 12, 1988

[54] CROSSED POLARIZATION SAME-ZONE TWO-FREQUENCY ANTENNA FOR TELECOMMUNICATIONS SATELLITES

[75] Inventors: Gilles Duret; Daniel Renaud, both of Frouzins; Hubert Diez, Leguevin, all of France

[73] Assignee: Alcatel Thomson Espace, Courbevoie, France

[21] Appl. No.: 754,320

[22] Filed: Jul. 12, 1985

[30] Foreign Application Priority Data

Jul. 17, 1984 [FR] France ..... 84 11293

[51] Int. Cl.[4] ..... H01Q 15/22

[52] U.S. Cl. ..... 343/756; 343/909; 343/840; 343/DIG. 2

[58] Field of Search ..... 343/909, 756, 914, 840, 343/DIG. 2

[56] References Cited

U.S. PATENT DOCUMENTS

| | | | |
|---|---|---|---|
| 2,483,575 | 10/1949 | Cutler | 343/784 X |
| 2,736,895 | 2/1956 | Cochrane | 343/756 |
| 2,922,160 | 1/1960 | Van Atta et al. | 343/840 X |
| 2,930,039 | 3/1960 | Ruze | 343/909 X |
| 2,982,961 | 5/1961 | Jones | 343/756 X |
| 3,049,708 | 8/1962 | Berkowitz | 343/756 X |
| 3,119,109 | 1/1964 | Miller et al. | 393/756 |
| 3,271,171 | 9/1966 | Hannan et al. | 343/909 X |
| 3,281,850 | 10/1966 | Hannan | 343/909 X |
| 3,898,667 | 8/1975 | Raab | 343/756 |
| 4,001,836 | 1/1977 | Archer et al. | 343/756 |
| 4,625,214 | 11/1986 | Parekh | 343/756 |

FOREIGN PATENT DOCUMENTS

| | | | |
|---|---|---|---|
| 1457907 | 12/1976 | United Kingdom | 343/756 |

*Primary Examiner*—Eugene R. LaRoche
*Assistant Examiner*—Benny T. Lee
*Attorney, Agent, or Firm*—Sughrue, Mion, Zinn, Macpeak, and Seas

[57] ABSTRACT

The antenna comprises a parabolic reflector (1) and a primary source (2). The reflector (1) comprises a first grating of conductor wires (7) and a second grating of conductor wires (8) which are orthogonal to the wires of the first grating, and with both gratings constituting elliptical reflective surfaces. The sizes of the major and minor axes of the ellipses are determined in such a manner that both operating frequencies of the antenna have identical coverge zones on the surface of the globe.

7 Claims, 3 Drawing Sheets

CROSSED POLARIZATION SAME-ZONE TWO-FREQUENCY ANTENNA FOR TELECOMMUNICATIONS SATELLITES

The present invention relates to a crossed polarization same-zone two-frequency antenna for telecommunications satellites enabling identical zones on the surface of the globe to be covered by two electromagnetic waves which are orthogonally polarized to each other.

BACKGROUND OF THE INVENTION

In order to cover identical zones on the surface of the globe using two radiated waves at different frequencies, a known antenna is constituted by a reflector of paraboloid shape situated opposite a primary source of electromagnetic waves placed at the focus of the reflector, the primary source being horn-shaped, for example, and being placed at the end of an electromagnetic waveguide.

Since the radiation pattern of the primary source has an aperture which varies as a function of the frequency of the radiated electromagnetic wave, this type of implementation provides an antenna whose efficiency is not the same for both of the waves reflected by the reflector, and in order to obtain signals of the same energy at the surface of the globe, the primary source must be adapted to compensate for the energy loss to which one of the waves is subjected relative to the other, with such compensation requiring the transmitter power supply devices in the satellite to be over-dimensioned.

Further, known antennas comprising a single reflector do not conserve completely orthogonal electric fields in each of their planes of polarization after reflection, so the isolation between the transmission channels constituted by the waves of different frequency cannot be totally effective.

Preferred embodiments of the present invention remedy these drawbacks.

SUMMARY OF THE INVENTION

The present invention provides a crossed polarization same-zone two-frequency antenna for telecommunications satellites, the antenna being of the type comprising a parabolic reflector having an apex S, an elliptical periphery, with a major axis $Dx_1$ and a minor axis $Dy_1$, and a primary source of spherical electromagnetic waves placed at the focus of the parabolic reflector, wherein said reflector comprises a first grating of conductive wires fixed to the concave face of the reflector which extend parallel to one another and to a plane passing through the axis of revolution of the paraboloid and along the major axis of the paraboloid, and a second grating of conductor wires orthogonal to the conductor wires of the first grating and placed inside the the first grating of conductors to form a reflecting surface having an elliptical periphery whose major axis $Dx_2$ is less than $Dx_1$ and whose minor axis $Dy_2$ is less than $Dy_1$, the centers of the ellipses formed by the peripheries of each of the reflecting surfaces being common, and the sizes of the major and minor axes of the ellipses of the two reflecting surfaces formed by the two gratings of conductors being so determined as to obtain the same coverage zone for the high frequency wave as for the low frequency wave.

BRIEF DESCRIPTION OF THE DRAWING

An embodiment of the invention is described by way of example with reference to the accompanying drawing, in which.

MORE DETAILED DESCRIPTION

Figure 1:
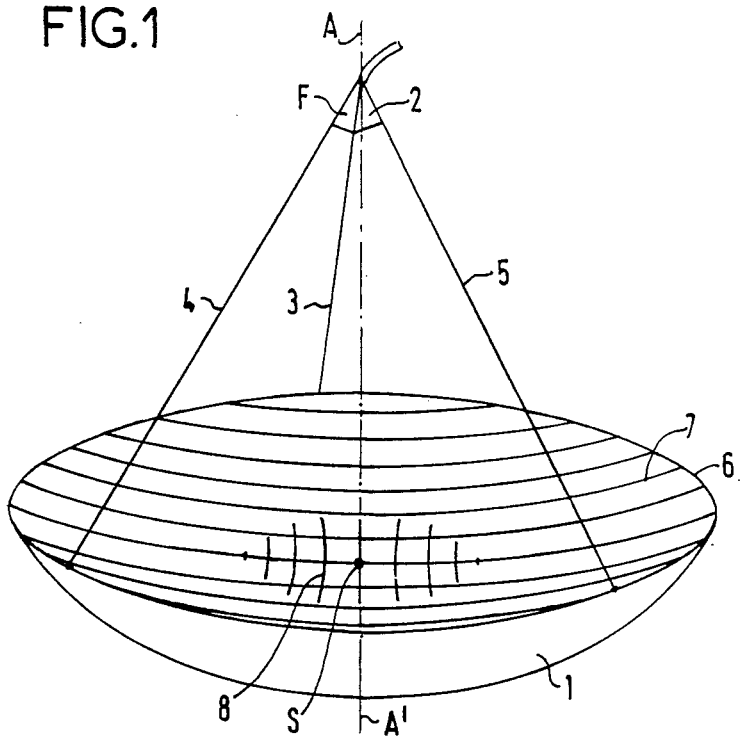
FIG. 1 is a perspective view of an antenna provided with a polarized parabolic reflector in accordance with the invention.

The parabolic antenna shown in FIG. 1 comprises a parabolic reflector 1 having an apex S and a primary source 2. The primary source 2 is constituted, for example, by means of a rectangular section horn and is located at the focus of the reflector by means of support arms 3, 4 and 5 which bear against the edge 6 delimiting the concave and convex surfaces of the reflector. The reflector 1 comprises a rigid parabolic structure made of synthetic material, e.g. Kevlar, aramid fiber, or any other equivalent dielectric material. KEVLAR is a registered trademark of Dupont de Nemours Corporation. A first electrically conducting polarizing grating 7 is disposed directly on the concave parabolic face of the reflector directly opposite the primary source 2, and a second polarizing grating 8, whose conductor wires are orthogonal to those of the first grating 7 is situated in the middle portion of the reflector. The first grating 7 is constituted by conductor wires extending over the entire area of the reflector facing the primary source along lines which mark the intersection of planes which are parallel to one another and to the direction of the main axis AA' of the paraboloid, said axis AA' passing through the apex S and the focus F of the paraboloid (see FIG. 1). The second grating 8 is likewise constituted by conductors which are likewise situated along the lines of intersection of mutually parallel planes which are also parallel to the direction of the axis AA' and which are orthogonal to the preceding planes defining the first conductor grating 7. The reflector is disposed relative to the primary source 2 in such a manner that the parallel wires of the gratings 7 and 8 are also parallel to the electric fields of respective ones of the two orthogonally polarized electromagnetic waves to ensure that each grating reflects only the corresponding one of the waves.

Figure 3:
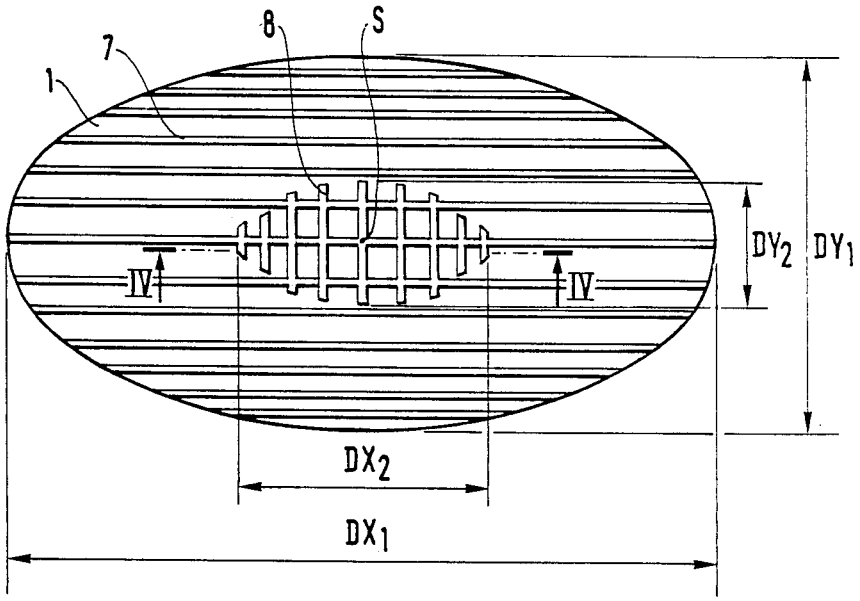
FIG. 3 is a front view of the reflector in accordance with the invention.
Figure 4:
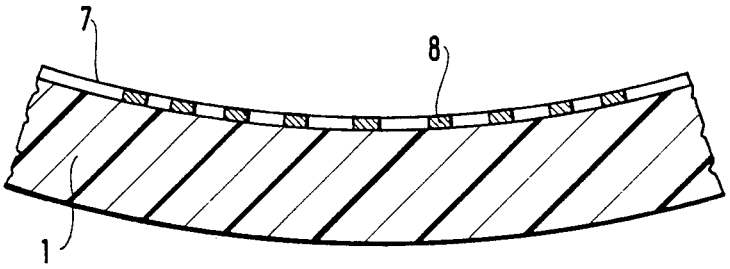
FIG. 4 is a section taken the line IV—IV of FIG. 3.

The conductors constituting the gratings 7 and 8 may be obtained by burying metal wires in the dielectric material or else by overall etching using a mask in contact with the surface of the reflector, or else by local etching as shown in FIGS. 3 and 4 using a laser, or else by etching the surface of the developed plane of the reflector as described in published French patent application No. 2 302 603, for example.

A reflector in accordance with the invention as described above has the advantage of reflecting two electromagnetic waves which are orthogonally polarized relative to each other and which are at different frequencies in such a manner as to obtain the same geographical coverage on the surface of the globe. The central portion of the reflector constituted by the area common to both orthogonal gratings 7 and 8 reflects both orthogonally polarized waves, whereas the peripheral portion outside the central grating 8 only reflects the low frequency polarized wave. The same zone coverage is obtained by determining the area and shape of the central grating in such a manner as to obtain the same zone coverage with the high frequency wave as is obtained by the grating 7 for the low frequency wave. The relevant calculations are explained below with reference to the front view of the reflector as shown in FIG. 2.

Figure 2:
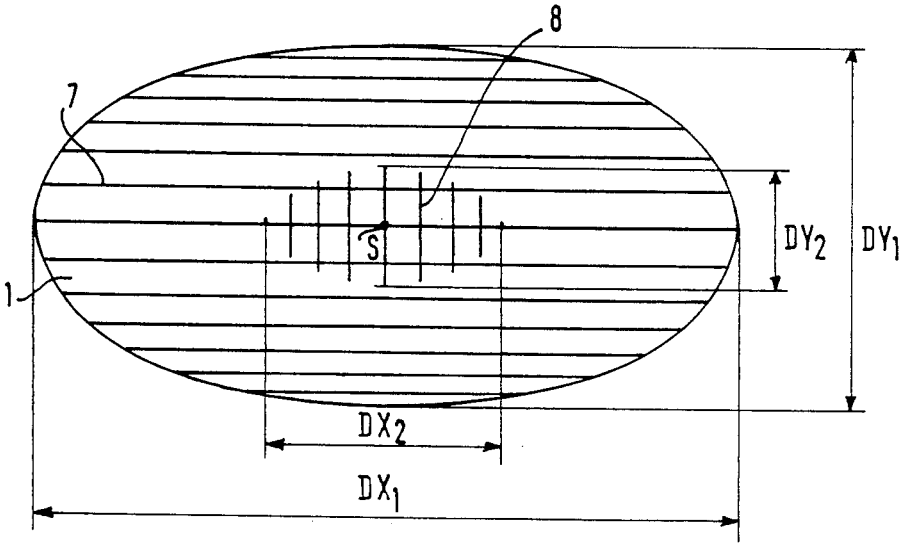
FIG. 2 is a front view of the reflector in accordance with the invention.
Figure 5:
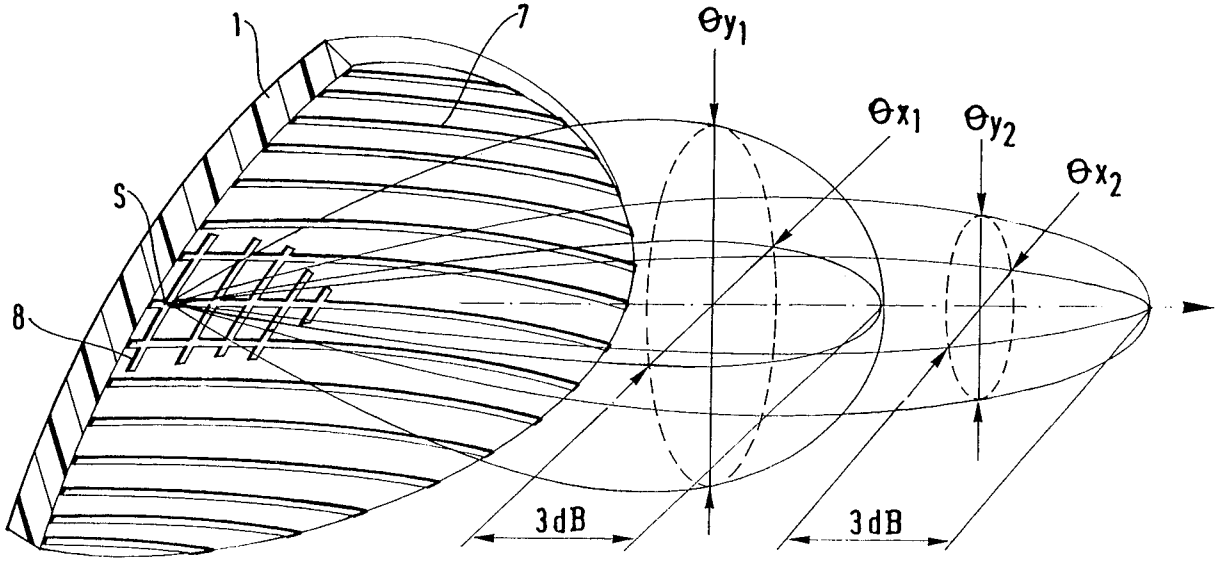
FIG. 5 is a diagrammatic perspective view showing the beam aperture angles for high and low frequency waves.

In FIG. 2, the reflector 1 extends over an elliptical area having a major axis $Dx_1$ and a minor axis $Dy_1$ as does grating 7, with the elliptical ratio being close to that required for the desired ground coverage. The grating 8 disposed in the middle of the reflector likewise extends over an interior elliptical zone of the reflector having a major axis $Dx_2$ and a minor axis $Dy_2$. The ellipses delimiting the areas of the gratings 7 and 8 have the same center. The low frequency spherical wave from the primary source 2 is transformed into a plane wave by the entire area of the reflector 1. In FIG. 5, the three decibel width of the resulting secondary radiation pattern has the following values in the main planes:

$$\theta x_1 = K_{11}(\lambda_1/Dx_1);$$

and $$\theta y_1 = K_{12}(\lambda_1/Dy_1)$$

where $\theta x_1$ and $\theta y_1$ designate the aperture angles of the beam in the corresponding main planes;

$K_{11}$ is a weighting coefficient for a section orthogonal to the electric field;

$K_{12}$ is a weighting coefficient for a section parallel to the electric field; and $\lambda_1$ is the wavelength of the low frequency wave.

The high frequency spherical wave is likewise transformed by the grating 8 in the middle of the reflector into a plane wave whose radiation pattern has a 3 dB width in the main planes as follows:

$$\theta x_2 = K_{21}(\lambda_2/Dx_2);$$

and $$\theta y_2 = K_{22}(\lambda_2/Dy_2)$$

where $\theta x_2$ and $\theta y_2$ designate the aperture angles of the beam in the corresponding main planes in FIG. 5;

$K_{21}$ is a weighting coefficient for a section orthogonal to the electric field;

$K_{22}$ is a weighting coefficient for a section parallel to the electric field; and $\lambda_2$ is the wavelength of the low frequency wave.

The two waves of wavelengths $\lambda_1$ and $\lambda_2$ have the same coverage zone when:

$$\theta x_1 = \theta x_2$$

and $$\theta y_1 = \theta y_2$$

i.e. when $$Dx_2 = K_{21}\lambda_2(Dx_1/K_{11}\cdot\lambda_1)$$

and $$Dy_2 = K_{22}\lambda_2(Dy_1/K_{12}\cdot\lambda_1)$$

When these conditions are satisfied, the beam aperture for the high frequency wave is very close to the aperture obtained for the low frequency, wave and zone coverage is provided at the same gain for both frequencies.

The invention is not limited to the embodiment described above, and naturally other embodiments are possible, in particular as a function of various kinds of primary source for use with such a reflector. In particular, it will be understood that the elliptical shape of the reflector and of the inner grating could readily be reduced to circles for use with some kinds of primary source in such antennas.

Further, in some particular applications, the centers of the ellipses delimiting the areas of the gratings 7 and 8 need not necessarily be located at the same point as the apex S of the reflector, e.g. when providing an offset type reflector.

We claim:

1. In a crossed polarization same-zone two-frequency antenna for telecommunications satellites, the antenna being of the type comprising a parabolic reflector having a concave face, an apex S, a main axis A-A', an elliptical periphery, with a major axis $Dx_1$ and a minor axis $Dy_1$, and a focus F and a primary source of spherical electromagnetic waves having high and low frequency components placed at the focus F of the parabolic reflector, the improvement wherein said reflector further comprises; a first grating of conductor wires fixed to the concave face of the reflector and forming a first reflecting surface, said first grating having the conductor wires extending along lines parallel to each other and in parallel with a plane defined by the main axis of the paraboloid, and the major axis of said elliptical periphery of said paraboloid, and a second grating of short conductor wires orthogonal to the conductor wires of the first grating, said second grating being lcoated within the elliptical periphery of the first grating of conductor wires said second grating being fixed on said concave face and intersecting said first grating conductor wires to form a second reflecting surface having an elliptical periphery with a major axis $Dx_2$ which is less than $DX_1$ and with a minor axis $Dy_2$ which is less than $Dy_1$, the first grating also having a periphery in the form of an ellipse and the centers of the ellipses formed by the peripheries of each of the reflecting surfaces being common, and the sizes of the major and minor axes of the ellipses of the two reflecting surfaces formed by the two gratings of conductors being such as to obtain the same coverage zone for the high frequency wave component as for the low frequency wave component.

2. An antenna according to claim 1, wherein the centers of the ellipses of the gratings are both located at the apex S of the parabolic reflector.

3. An antenna according to claim 1, wherein the reflector is constituted by dielectric material having conductor wires embedded therein to constitute said first and second gratings of conductor wires.

4. An antenna according to claim 1, wherein the conductor wires of each of said gratings are etched in respective reflecting surfaces of the reflector.

5. An antenna according to claim 1, wherein the conductor wires of the first and second gratings are etched in respective reflecting surfaces of the reflector by an over-developed plane engraving method.

6. An antenna according to claim 1, wherein said reflector has a rim at its outer periphery formed by an elliptical conductor wire of the first grating and the primary source of electromagnetic waves is constituted by a rectangular section horn held at the focus F of the reflector by means of a support arm connected to the rim of the reflector.

7. An antenna according to claim 1, wherein said primary source radiates two electromagnetic waves as two perpendicular electric fields and the reflector is so oriented relative to the primary source that the parallel conductor wires of the first grating and of the second grating are also parallel to the two perpendicular electric fields of respective ones of the two electromagnetic waves radiated by the primary source.

* * * * *